US006778160B2

(12) United States Patent
Kubota et al.

(10) Patent No.: US 6,778,160 B2
(45) Date of Patent: Aug. 17, 2004

(54) LIQUID-CRYSTAL DISPLAY, LIQUID-CRYSTAL CONTROL CIRCUIT, FLICKER INHIBITION METHOD, AND LIQUID-CRYSTAL DRIVING METHOD

(75) Inventors: Tetsu Kubota, Fujisawa (JP); Akihiro Funakoshi, Kamakura (JP); Takuya Ishikawa, Hino (JP)

(73) Assignee: International Business Machines Corporation, Armonk, NY (US)

( * ) Notice: Subject to any disclaimer, the term of this patent is extended or adjusted under 35 U.S.C. 154(b) by 218 days.

(21) Appl. No.: 09/760,131

(22) Filed: Jan. 12, 2001

(65) Prior Publication Data

US 2001/0024181 A1 Sep. 27, 2001

(30) Foreign Application Priority Data

Jan. 17, 2000 (JP) ..... 2000-007816

(51) Int. Cl.[7] ..... G09G 3/36

(52) U.S. Cl. ..... 345/89; 345/98; 345/77; 345/88; 345/690

(58) Field of Search ..... 345/88, 63, 89, 345/77, 90, 87, 611, 690, 147, 148, 211, 102, 212

(56) References Cited

U.S. PATENT DOCUMENTS 5,347,294 A * 9/1994 Usui et al. ..... 345/89
5,483,634 A * 1/1996 Hasegawa ..... 359/162
5,956,014 A * 9/1999 Kuriyama et al. ..... 345/147
6,064,359 A * 5/2000 Lin et al. ..... 345/89
6,075,514 A * 6/2000 Ryan ..... 345/601
6,326,938 B1 * 12/2001 Ishida et al. ..... 345/63
6,333,727 B2 * 12/2001 Mizumaki ..... 345/89

FOREIGN PATENT DOCUMENTS

| | | |
|---|---|---|
| JP | 4-365094 | 12/1992 |
| JP | 06-062355 | 3/1994 |
| JP | 07-056532 | 3/1995 |
| JP | 8-8671 | 1/1996 |

* cited by examiner

*Primary Examiner*—Regina Liang
*Assistant Examiner*—Jennifer T. Nguyen
(74) *Attorney, Agent, or Firm*—Derek S. Jennings; David Aker

(57) ABSTRACT

A liquid crystal display comprises an input for inputting a video signal from a host and a storage medium for storing the previous brightness level of the video signal input through the input. A determinator is provided for determining an output brightness level based on the previous brightness level stored in the storage medium and the next brightness level of the next video signal input to the input, so as to make the time integration quantity of a brightness change substantially equal to an ideal quantity of light in a stationary state with respect to the next brightness level. Further included are drivers for driving an image displaying liquid crystal cell based on the output brightness level determined by the determinator.

14 Claims, 11 Drawing Sheets

[Figure 1]
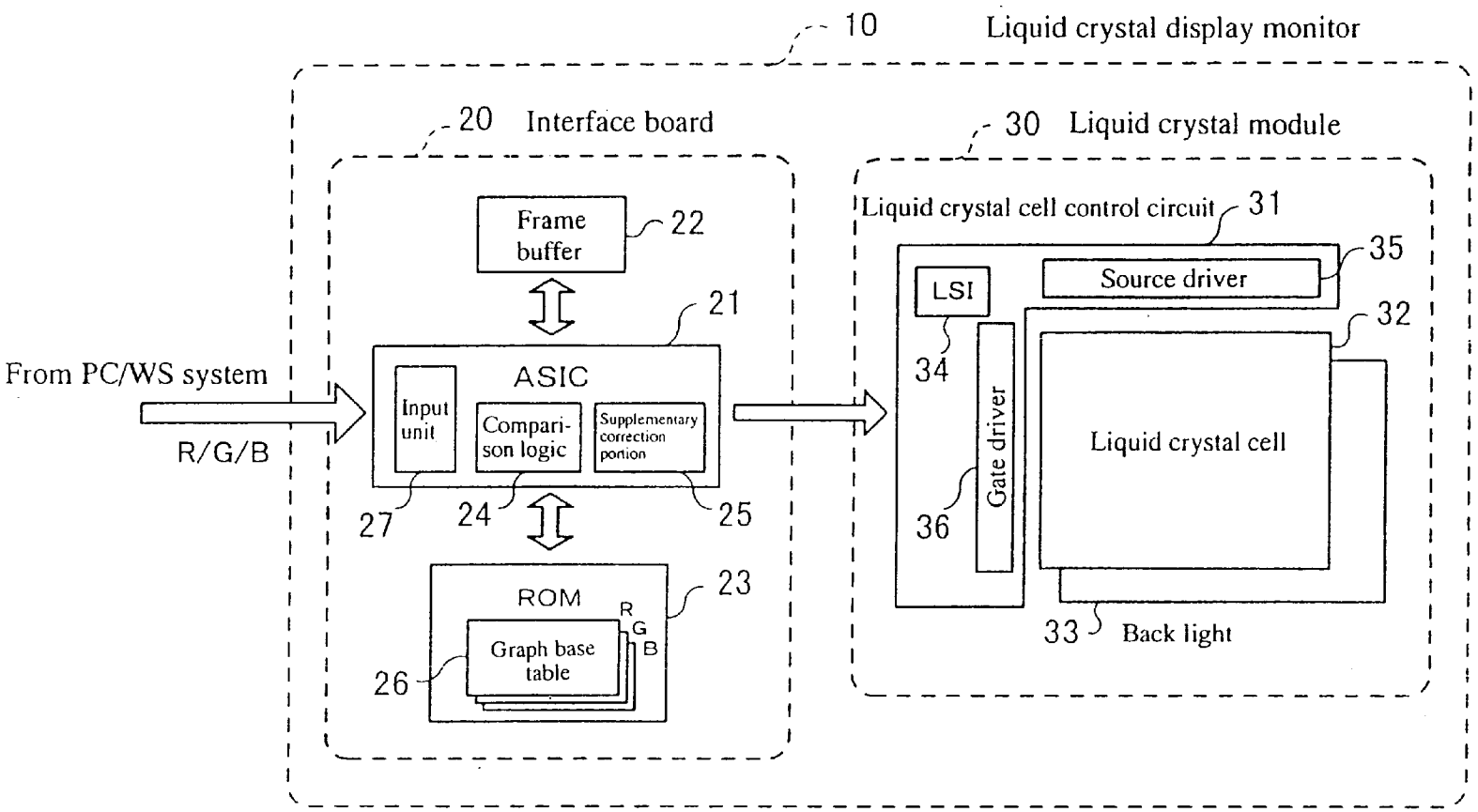

[Figure 2]
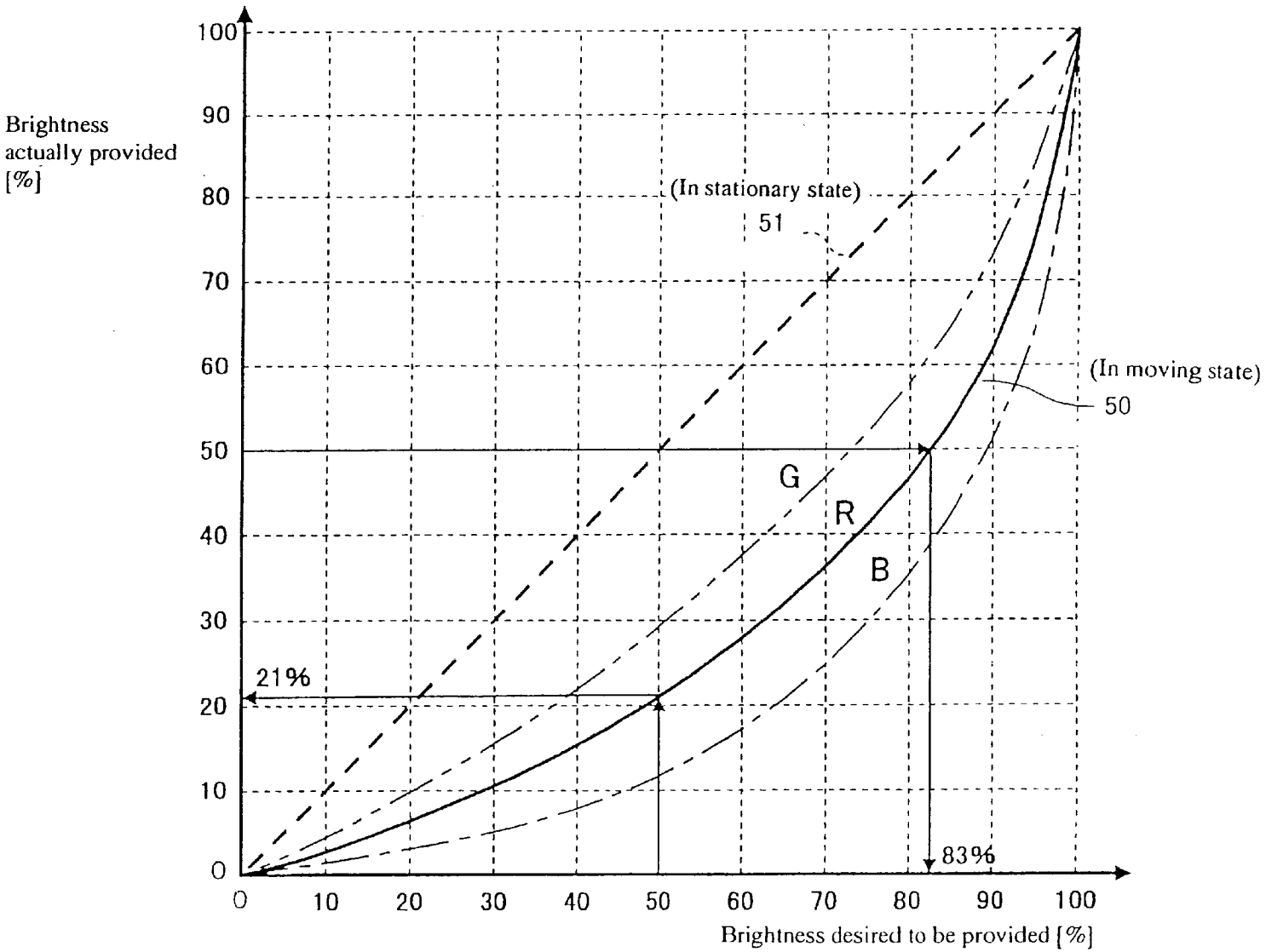

[Figure 3]

| 61 Model (Magnitude of flicker) | 62 Response rising time | 63 Response falling time | 64 Light quantity ratio (to ideal LC) | 65 Brightness ratio of drawing in moving state to that in stationary state |
|---|---|---|---|---|
| Model A (○) | 20. 3ms | 21. 6ms | 1. 02 : 1 | 1. 0 : 1 |
| Model B (×) | 18. 5ms | 10. 0ms | 0. 81 : 1 | 0. 8 : 1 |
| Model C (△) | 10. 0ms | 4. 5ms | 0. 85 : 1 | 0. 9 : 1 |
| Model D (×) | 19. 9ms | 7. 9ms | 0. 73 : 1 | 0. 7 : 1 |
| Model E (×) | 43. 2ms | 34. 3ms | 0. 53 : 1 | 0. 3 : 1 |

[Figure 4]
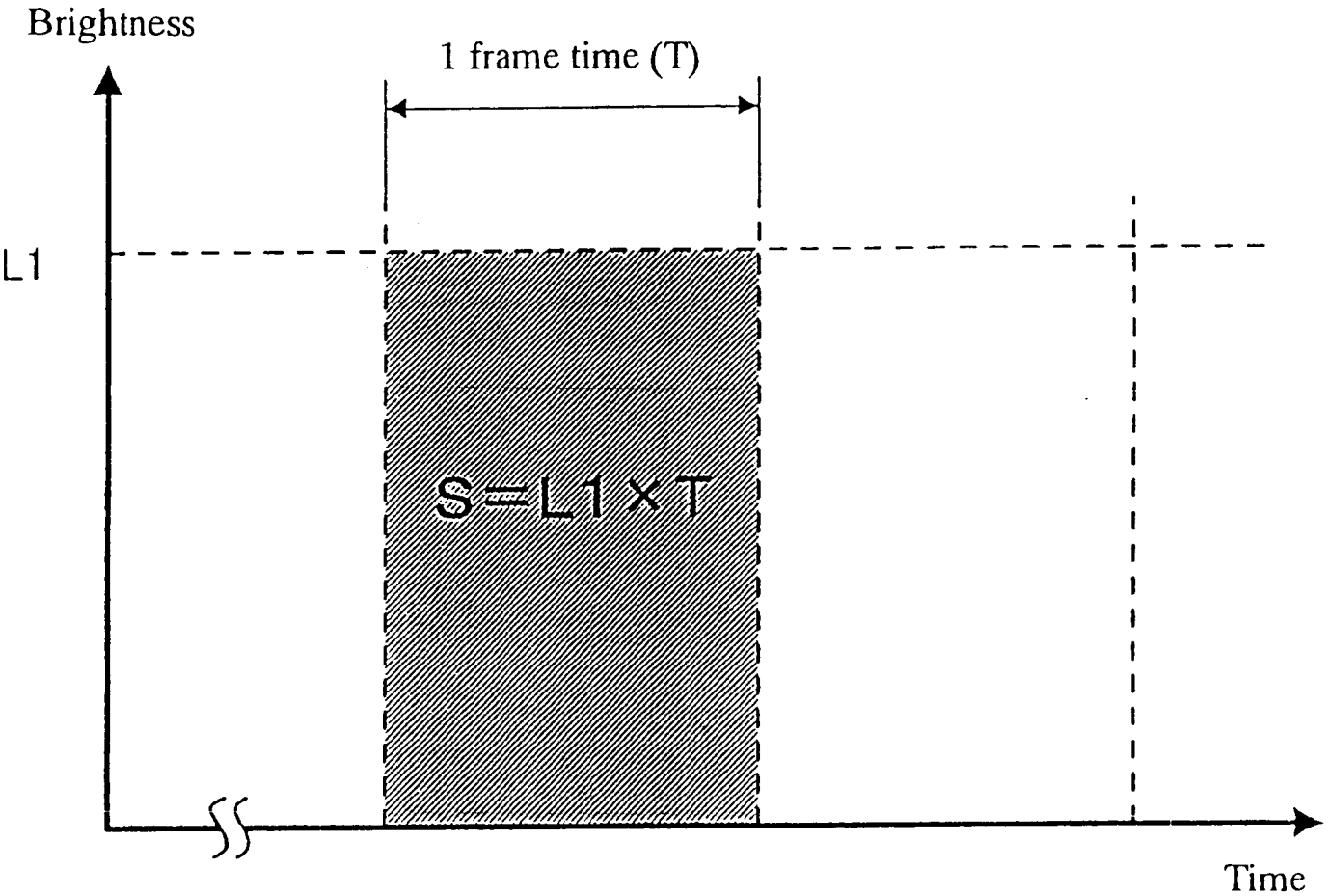

[Figure 5]
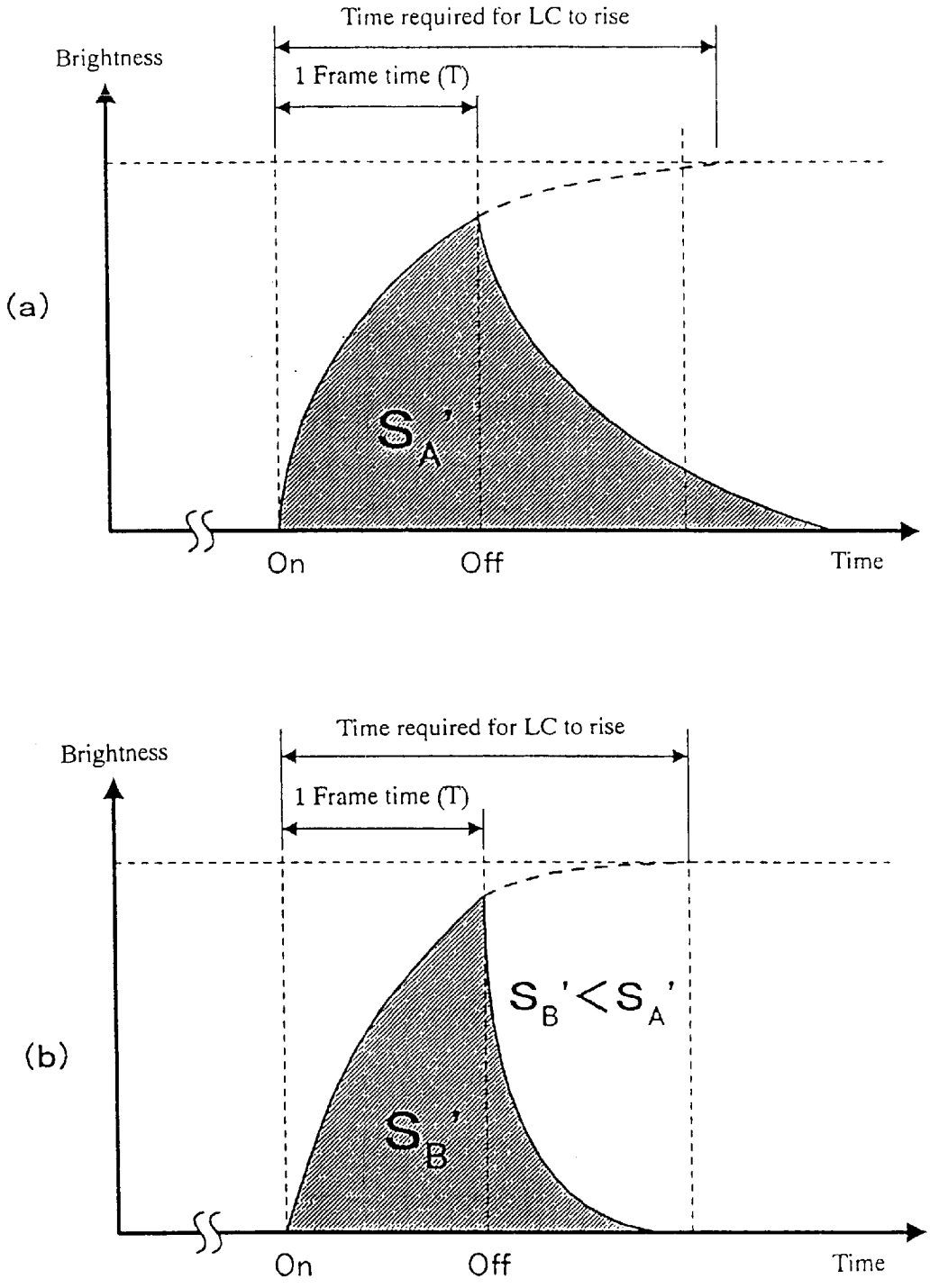

[Figure 6]
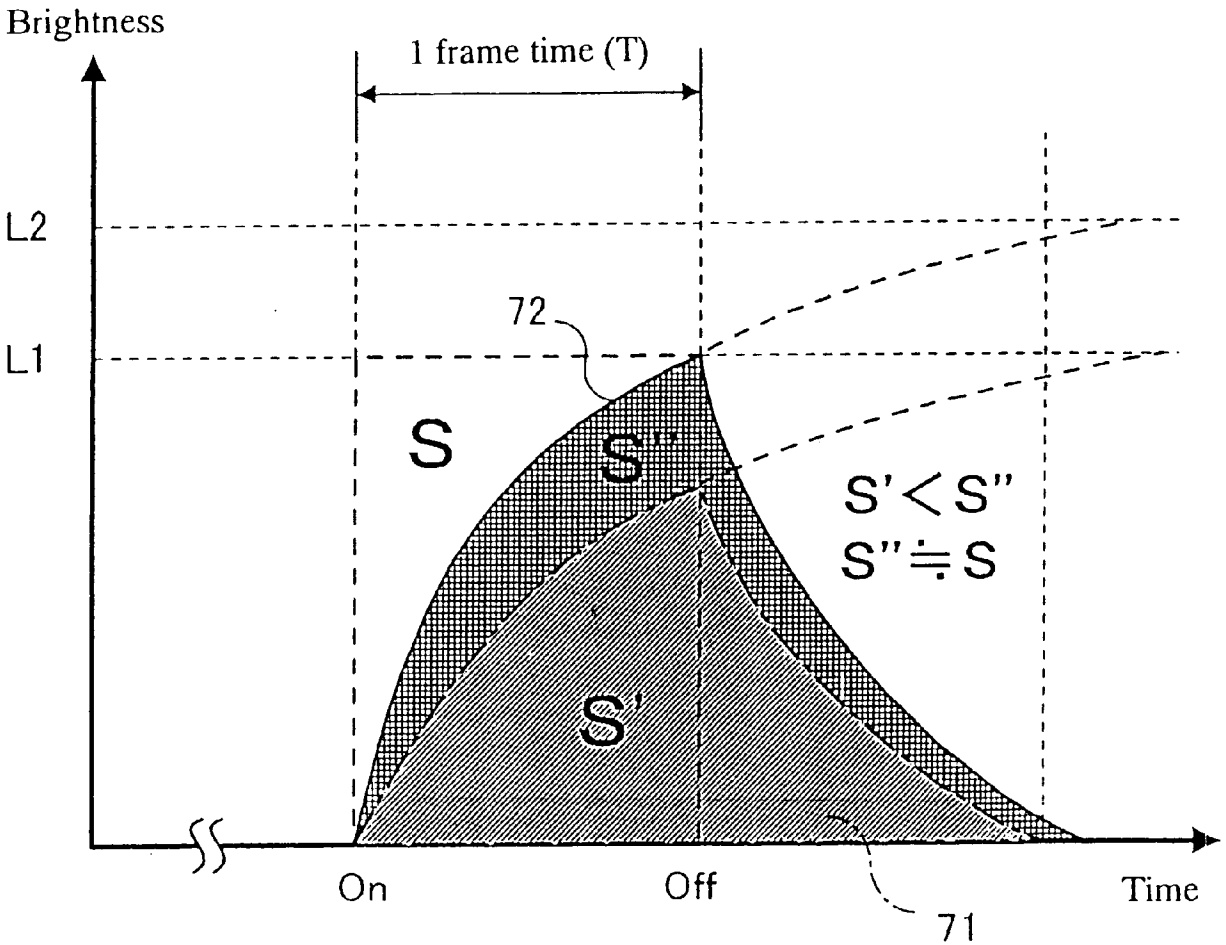

[Figure 7]

26 (Graph base table)

| Previous brightness \ Next brightness | 0 | 10 | 20 | 30 | 40 | 50 | 60 | 70 | 80 | 90 | 100 |
|---|---|---|---|---|---|---|---|---|---|---|---|
| 0 | 0 | 28 | 48 | 63 | 74 | 83 | 88 | 93 | 96 | 98 | 100 |
| 10 | 0 | 10 | 30 | 45 | 56 | 65 | 70 | 75 | 80 | 90 | 100 |
| 20 | 0 | 10 | 20 | 35 | 46 | 55 | 60 | 70 | 80 | 90 | 100 |
| 30 | 0 | 10 | 20 | 30 | 41 | 50 | 60 | 70 | 80 | 90 | 100 |
| 40 | 0 | 10 | 20 | 30 | 40 | 50 | 60 | 70 | 80 | 90 | 100 |
| 50 | 0 | 10 | 20 | 30 | 40 | 50 | 60 | 70 | 80 | 90 | 100 |
| 60 | 0 | 10 | 20 | 30 | 40 | 50 | 60 | 70 | 80 | 90 | 100 |
| 70 | 0 | 10 | 20 | 30 | 40 | 50 | 59 | 70 | 80 | 90 | 100 |
| 80 | 0 | 10 | 20 | 30 | 40 | 45 | 54 | 65 | 80 | 90 | 100 |
| 90 | 0 | 10 | 20 | 25 | 30 | 35 | 44 | 55 | 70 | 90 | 100 |
| 100 | 0 | 2 | 4 | 7 | 12 | 17 | 26 | 38 | 52 | 72 | 100 |

[Figure 8]
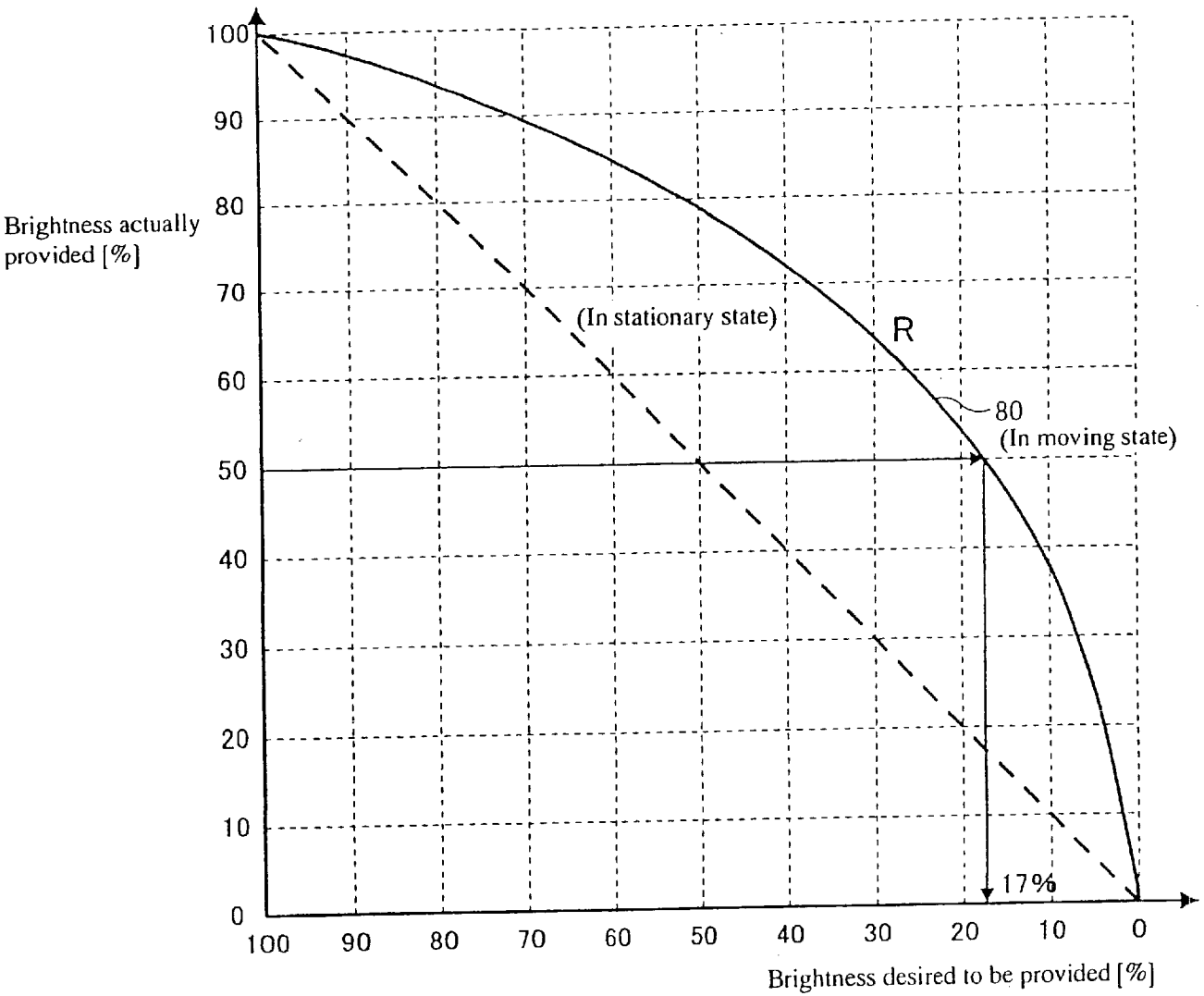

[Figure 9] PRIOR ART
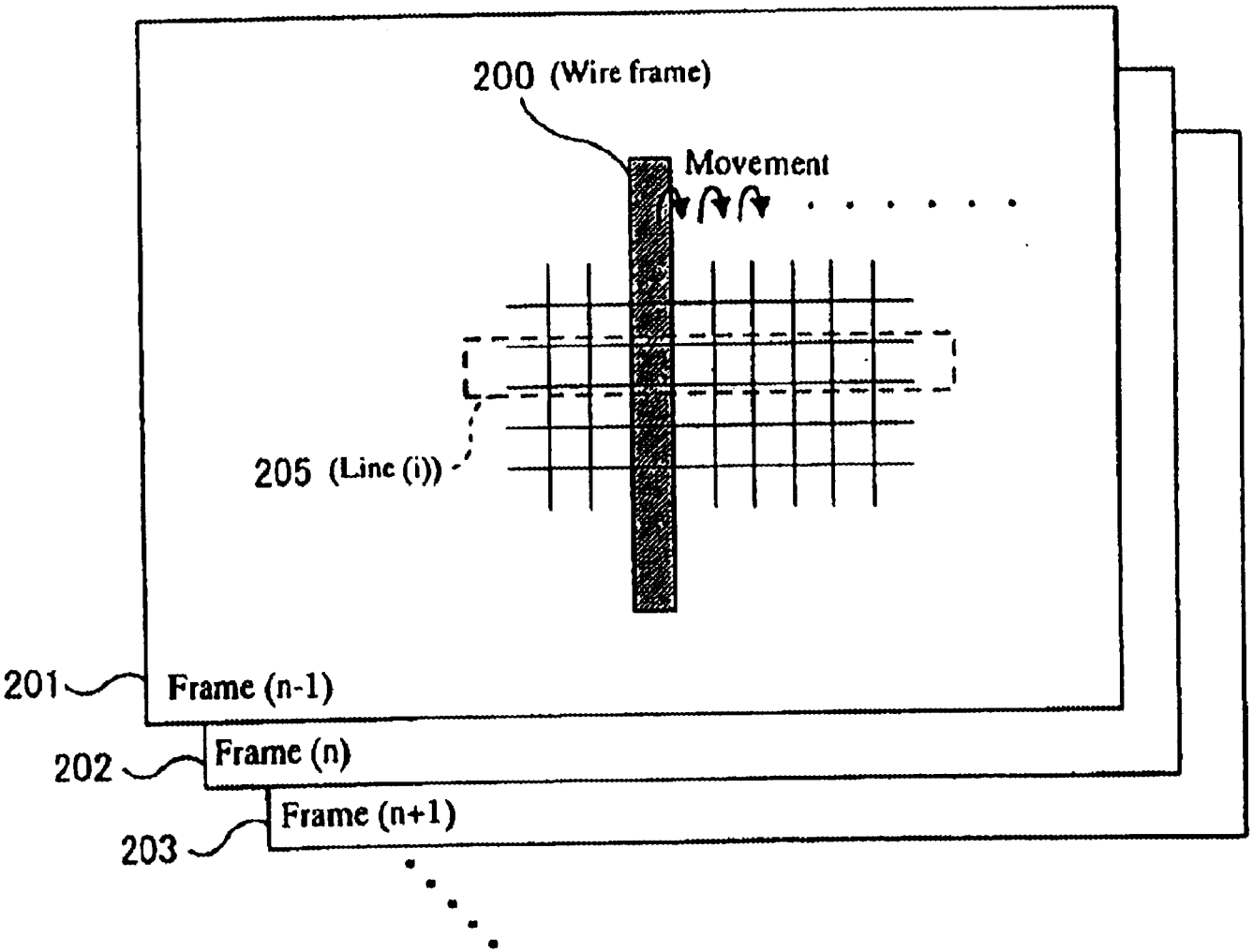

[Figure 10] PRIOR ART
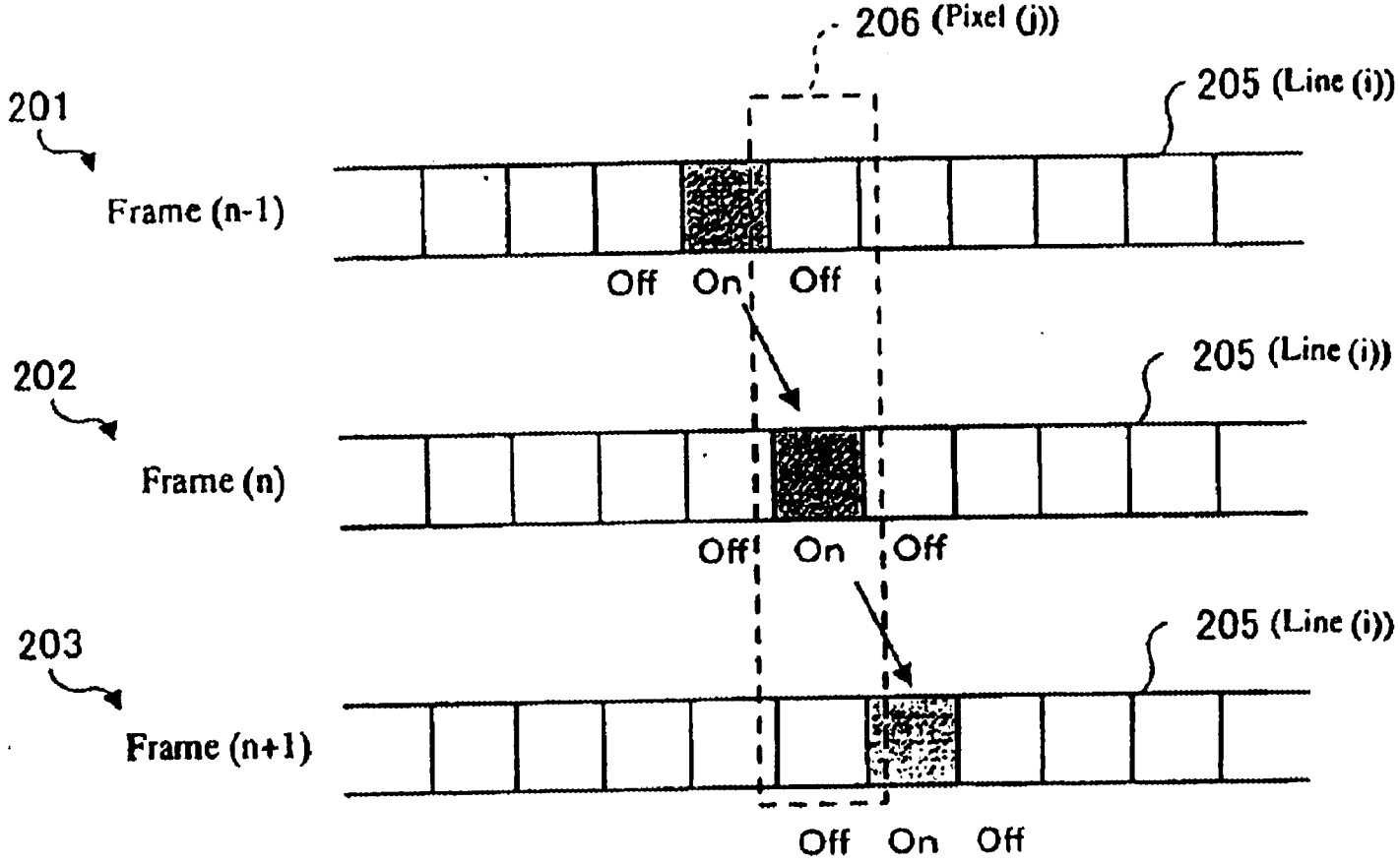

[Figure 11] PRIOR ART
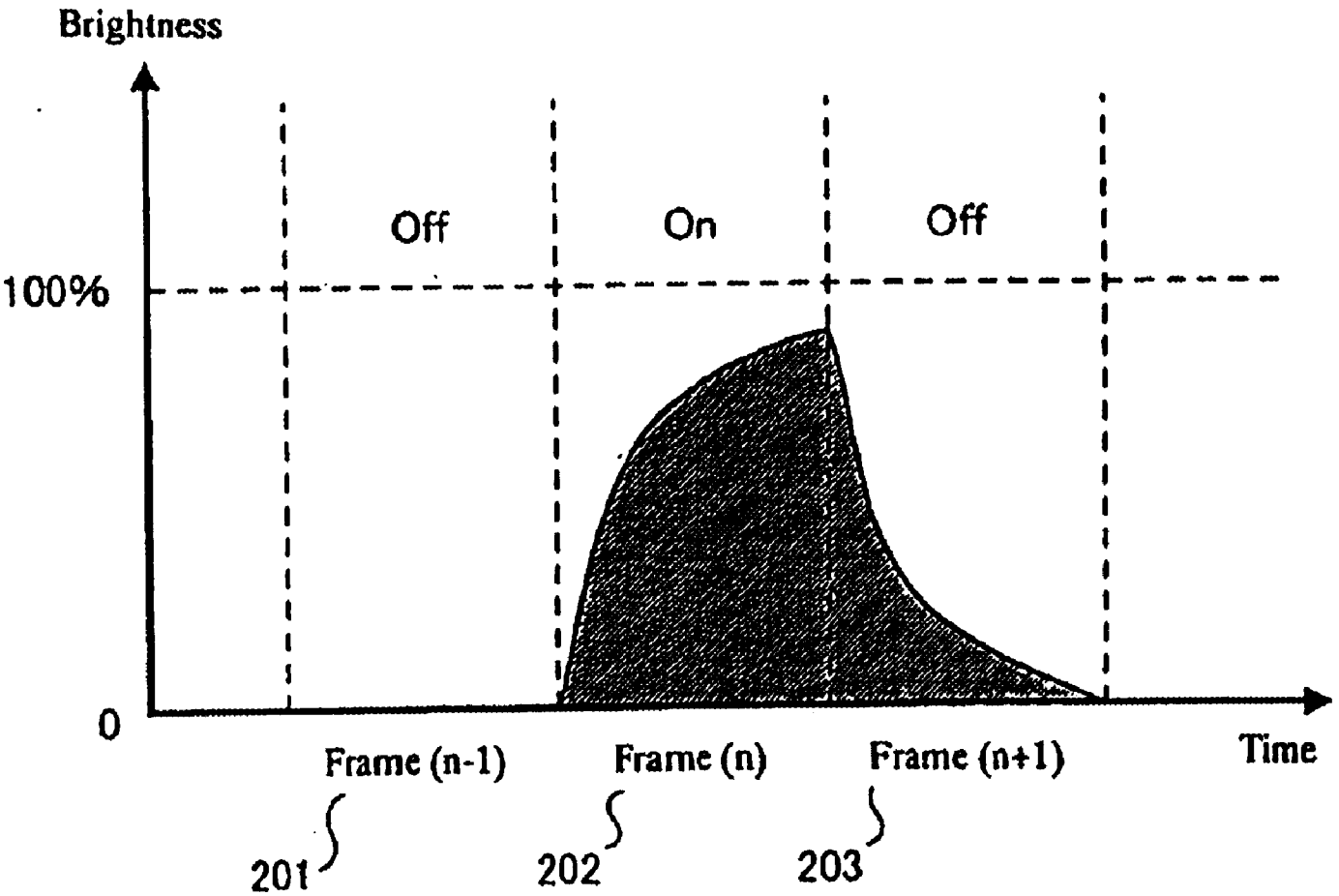

LIQUID-CRYSTAL DISPLAY, LIQUID-CRYSTAL CONTROL CIRCUIT, FLICKER INHIBITION METHOD, AND LIQUID-CRYSTAL DRIVING METHOD

FIELD OF THE INVENTION

The present invention relates to a method for compensating poor response time, and in particular, to a method and an apparatus for inhibiting flicker resulting from the poor response time of a liquid crystal display.

BACKGROUND OF THE INVENTION

In recent years, besides cathode ray tubes (CRTs), liquid crystal displays (LCDs) have come into widespread use as display devices for various types of image displays and monitors for units such as personal computers (PCs) and television sets. The LCDs can be made significantly smaller and lighter than CRTs. In addition, many improvements in the display performance of LCDs, including low geometric distortion as well as considerably high picture quality, have been achieved. For these reasons, the LCDs have gained the spotlight as a mainstream display device used in video equipment of the future.

However, because of the poor response characteristic of the liquid crystal itself, the LCDs has the potential problem of poor response time. That is, in a typical display device used in the industry, the display is refreshed at a frame rate of 60 frames per minute, or, every (1÷60=) 16.7 ms. On the other hand, the response time of liquid crystals used in many current LCDs required to change from black to white is 10 to 50 ms, typically 20 to 30 ms. This means that one frame time in the display is shorter than the response time of most liquid crystals. As a result, problems, such as the visual persistence of moving images and inability to keep up with fast-moving images, caused by the response delay of the LCDs have become obvious.

The term "response time" used in the industry refers to the sum of (1) time required to reverse color by applying a voltage to a liquid crystal cell and (2) time required to restore the original color by the removal of the applied voltage. The term "frame" used in the industry represents the scanning of all the images (picture elements) that should form one complete picture on the display.

Some solutions to these poor response time problems with the LCD are disclosed in, for example, Published Unexamined Japanese Patent Applications Nos. 2-153687, 4-365094, 6-62355, and 7-56532.

In Published Unexamined Japanese Patent Application No. 2-153687, a LCD is provided which is configured to discriminate between a static image area having less motion and a fast-moving area and apply a signal process only to the moving area to emphasize time-based changes in an image, thereby improving response time in the image area where better response time is required to reduce visual persistence and noise.

In Published Unexamined Japanese Patent Application No. 4-365094, a LCD is provided which is configured to be driven by reading pre-stored optimum image data according to the direction and degree of a change when the image data changes, thereby allowing the LCD to rapidly follow the fast-changing image.

In Published Unexamined Japanese Patent Application No. 6-62355, a technology is disclosed which superposes a difference component between fields or frames on a video signal to provide pulse stepping drive when the video signal changes between the fields or frames, thereby improving the response of display elements in an LCD.

In Published Unexamined Japanese Patent Application No. 7-56532, a technology is disclosed which provides table memory containing a table of image increase/decrease values and drive a liquid crystal panel (liquid crystal cell) by performing an addition/subtraction in order to improve response changes due to changes in the gray scale in the liquid crystal panel. However, the amount to be added or subtracted is expressed only by the word "optimum" and no specific amount is disclosed.

One problem associated with picture quality in LCDs which do not arise in a CRT display is flicker. When, for example, a wire-frame model in a CAD application is displayed on the LCD and the operator (user) moves it continuously at a relatively low speed, about several tens pixels per minute, the entire wire-frame model appears to blink in a cycle of several to several tens Hz. This effect is called flicker. While this effect does not occur in CRT displays, it occurs in most existing types of LCDs and many customers have requested minimization of the flicker urgingly. The flicker herein differs in symptom and cause from that in CRT displays which is caused by infrequent refresh.

In CAD applications, a wire-frame model is typically displayed using many thin lines in white or other colors against a black background. Assuming that the wire-model is white (all of the colors R (read)/G (green)/B (blue) are "ON") as an example, no problem arises when the model stay stationary on the screen because only a few frames are required to achieve an proper brightness. However, if the operator move the model on the screen, the proper brightness cannot completely be achieved. That is, if a pixel is made light up only in one frame, the brightness of the pixel may not reach the predetermined brightness because the response of the LCD itself is slow as mentioned above. This situation will be described below with reference to the drawings.

FIG. 9 shows the movement of lines when a wire-frame model is moved on the screen. FIG. 10 shows on/off states of the pixels on line (i) in each frame at the time point in FIG. 9. FIG. 11 shows a change in the brightness of pixel (j).

Herein, as shown in FIG. 9, in the case where attention is paid to a particular pixel, assuming that a line of the wire frame 200 moves through frames (n−1) 201 to (n) 202 to (n+1) 203 in sequence. That is, the pixel lights up in a time period equivalent to the frames in which the line passes over the pixel and goes off immediately after that.

Focusing attention on line (i) 205 represented by a dashed line, in particular, on the particular pixel, each frame is driven from OFF to ON by the movement of pixel (j) 206, then one frame after goes back from ON to OFF, as shown in FIG. 10. However, because the response time of commonly-used liquid crystals is longer than 16.7 ms, pixel (j) 206 changes back to black before completely returning from black to white. That is, as shown in FIG. 11, pixel (j) 206 is OFF in frame (n−1) 201, goes ON in frame (n) 202, then goes OFF in frame (n+1) 203. However, the target brightness of pixel (j) 206 is not reached even though it is turned on in order to achieve 100% brightness in frame (n) 202. As a result, the brightness of the line drawing during movement will be low. The inventors have found that when a wire-frame model is continuously moved in a CAD application, the wire-frame model in fact repeatedly alternates between moving and stationary states every several frames and blinks due to a difference in display brightness between the moving and stationary states, and this difference causes "flicker."

Many manufacturers have actively sought after a method for improving the response of LCD panels by improving a liquid crystal material itself or narrowing the gap between glass plates in order to reduce flicker of LCDs. Some state-of-the-art products on the market have an improved response time of about 25 ms including rising and falling time. Another LCD technologies for reducing response time to several ms have been disclosed in some academic conferences. However, these approaches to improve an LCD panel itself can hardly to provide mass-production products because of their low reliability, and there are many other problems to be solved to put them into practical use.

In view of these technical problems, it is a primal object of the present invention to inhibit the flicker effect as visual perception by the panel driving circuitry which drives an LCD.

It is another object of the present invention to drive the LCD by applying an offset to a moving model without globally determining whether the model is moving or stationary.

SUMMARY OF THE INVENTION

To achieve above-mentioned objects, a feature of the present invention includes a liquid crystal display comprises an input for inputting a video signal from a host and a storage medium for storing the previous brightness level of the video signal input through the input. A determinator is provided for determining an output brightness level based on the previous brightness level stored in the storage medium and the next brightness level of the next video signal input to the input, so as to make the time integration quantity of a brightness change substantially equal to an ideal quantity of light in a stationary state with respect to the next brightness level. Further included are drivers for driving an image displaying liquid crystal cell based on the output brightness level determined by the determinator.

Another feature of the present invention includes a liquid crystal display characterized by comprising a driver for driving each of the pixels forming an image for each frame to a liquid crystal cell displaying the image, an input for inputting an moving-state video signal which changes from the off state to the on state on transition to a particular frame in the frames and returns to the off state after the particular frame is completed, and elements for setting an offset for making the quantity of light closer to the quantity of light in a stationary state in which the moving-state video signal is continuously turned on for the particular frame. The liquid crystal display further includes a generator for applying the offset set by the setting elements to the moving-state video signal input through the input means to generate an output video signal, and an output for outputting the output video signal generated by the generation means to the drive means. By configuring the apparatus in this way, a difference in brightness between a stationary state and a moving state which can be considered as the principal cause of flicker can be reduced to inhibit visually perceptible flicker.

Yet another feature of the present invention is further characterized by a liquid crystal control circuit having a function for inhibiting flicker caused by a difference in brightness when an input wire-frame model is displayed by liquid crystal cells. The liquid crystal control circuit includes a storage portion for storing an offset in brightness in a moving state in which the wire-frame model having a predetermined gray scale changes from frame to frame with respect to a particular pixel. This is with relation to brightness output in a stationary state in which the wire-frame model having the predetermined gray scale is displayed on the particular pixel across a plurality of frames. Further included is a correction portion for applying the offset stored in the storage portion to the gray scale of the wire-frame model if the input wire-frame model is in a moving state.

BRIEF DESCRIPTION OF THE DRAWINGS

FIG. 1 is a schematic diagram for showing the overall configuration of a liquid crystal display (LCD) apparatus according to one embodiment of the present invention.

FIG. 2 is a graph showing an example of brightness of a wire-frame image in a moving state on the LCD used with the embodiment.

FIG. 3 is a table showing the measurements of response time at the maximum brightness of a liquid crystal used in five LCD models (model A to E).

FIG. 4 shows the response characteristic of an ideal liquid crystal.

FIGS. 5 (*a*) and (*b*) are graph showing the response characteristics of models A and B shown in FIG. 3 by brightness versus time when a pixel is turned on for only one frame.

FIG. 6 shows an effect when brightness is set by taking a required offset into consideration.

FIG. 7 shows a relation between brightness L1 and brightness L2 in table form;

FIG. 8 is a graph showing desired brightness versus brightness actually provided when brightness falls.

FIG. 9 shows the movement of a line on the screen when a wire-frame model is moved on the screen.

FIG. 10 shows the ON/OFF states of a pixel on line (i) in each frame.

FIG. 11 shows changes in brightness of pixel (i).

DETAILED DESCRIPTION OF THE INVENTION

The "ideal quantity of light" herein is, to take an example, the quantity of light based on a response characteristic which provides a target brightness level at a time point at which the frame is turned on and provides a brightness level of zero at the time point at which the frame is turned off on a display device in which each pixel is driven for each frame. The brightness level can be represented as a target brightness value by a gray scale and considered as an indication of the characteristic of human visual sensation to brightness. In addition, a brightness change can be considered as a response characteristic depending on the types of liquid crystal cells (liquid crystal panels). Quantity of light is considered as a time integration quantity of a brightness change and can be expressed as brightness_time, if the brightness is constant. The representation "substantially equal level" refers to a level which is not completely the same but can be accepted as a substantially equivalent level, and includes a level which is closer to an ideal quantity of light than no preventive measures are taken.

The determinator is characterized by comprising a table for storing a brightness level determined by the characteristic of a liquid crystal cell according to a relation between the previous brightness level and the next brightness level, and determining an output brightness level by modifying the next brightness level based on the brightness level read from the table. With this configuration, flicker due to changes in the quantity of light during the movement of the model can be inhibited without globally determining whether a model is in a moving or stationary states. In addition, a correction for a "halftone" can be made, thereby allowing a decrease in brightness level, which is remarkable in halftones, to be addressed properly.

The video signal input through the input consists of a plurality of color signals and the table in the determinator is provided for each of the color signals so that a brightness level correction for each color can be made with respect to flicker perception of the human eye to reduce a difference in brightness, thereby an easy-on-the-eye liquid crystal display can be provided to the user. While the color signals may be R (read), G (green), B (blue) signals used in displays, other display systems can also be used.

The offset set by the setting elements can be determined based on a time integration quantity, which is a change in brightness in the moving-state vide signal integrated with respect to time, and the quantity of light in stationary state, thus a difference in brightness can be preferably reduced in consideration of the human visual perception characteristic to inhibit flicker appropriately.

The moving-state video signal passed through the input consists of a plurality of color signals, the offset set by the setting elements is determined for each of the color signals, and the generator generates the output video signal for each color signal based on the offset determined for each color signal. Thus a difference in brightness between moving and stationary states can be corrected for each color signal to inhibit flicker on a color image display.

The apparatus further comprises a frame buffer for storing the brightness information of the input wire-frame model as the previous brightness, and characterized by that the storage portion stores the offset as table information based on a relation between the previous brightness stored in the frame buffer and the brightness of the next input wire-frame model, thus, flicker in a moving state can be advantageously inhibited without providing separate determining units for moving and stationary states.

Because the wire-frame model in the present invention is a model consisting of a large number of thin lines in white or other colors in a CAD application, for example, in which flicker is especially troublesome, the flicker inhibition by correcting gray scale of such a wire-frame model in a moving state is highly effective.

The liquid crystal control circuit may be implemented as an interface board provided in a liquid crystal display monitor. The liquid crystal display monitor may be one used with a desktop personal computer or a CAD computer as well as one integrated with a host, like a notebook computer.

In another category, the present invention is a flicker inhibition method for inhibiting flicker caused by a difference in brightness when an input wire-frame model is displayed by a liquid crystal cell. The method is characterized by storing a relation between brightness in a stationary state in which a wire-frame model having a predetermined gray scale is displayed on a particular pixel across a plurality of frames and brightness in a moving state in which the wire-frame model having the predetermined gray scale changes frame to frame with respect to the particular pixel, applying an offset based on the stored relation to the gray scale of the wire-frame model if the input wire-frame model is in a moving state, and driving the liquid crystal cell based on the gray scale to which the offset is applied to display the wire-frame model.

The moving state brightness used for storing the relation is the brightness when the particular pixel changes back to the off state one frame after it is driven from the off state to the on state during the passage of the wire-frame model over the particular pixel.

Furthermore, the brightness in the moving state which is used when the relation is stored is the quantity of light equal to the brightness change integrated with respect to time.

With this configuration, a difference in the brightness of the wire-frame model between its moving state and stationary state can be reduced to inhibit flicker which would otherwise noticeably occur.

Viewing the present invention as a liquid crystal driving method, the liquid crystal driving method of the present invention is characterized by the steps of storing first brightness information for an input pixel in a frame buffer, and applying, based on second brightness information for the next input pixel and the first brightness information stored in the frame buffer, an offset for making the time integration quantity of a brightness change substantially equal to an ideal light quantity which is brightness in a stationary state to the second brightness information. The steps further include the outputting of the second brightness information to which the offset is applied to a driving circuit for driving an liquid crystal cell, and storing the second brightness information for the input pixel in a frame buffer. This liquid crystal driving method allows the inhibition of flicker by using a simple apparatus without globally determining whether a model is moving or stationary.

The present invention is still further characterized in that the input pixel consists of a plurality color signals and includes the step of storing the first brightness information in the frame buffer stores the first brightness information for each of the color signals, and the step of applying the offset applies the offset to each of the color signals, thus the brightness of each color of a color image consisting of a plurality of color signals can be corrected individually, allowing more adequate flicker inhibition.

The offset applying step is characterized by the step of reading a pre-stored offset based on the relation between the first and second brightness information and applying the read offset to the second brightness information.

The brightness information at a moving time that is used in a storage operation based on the relation is the quantity of light equal to a brightness change for each color signal integrated with respect to time, therefore correction according to the human visual perception characteristics can be made to address the problems resulting from human visual perception of flicker more properly.

The present invention will be described below with respect to the embodiments shown in the accompanying drawings.

FIG. 1 is a drawing for showing the overall configuration of a liquid crystal display according to an embodiment of the present invention. Reference number 10 denotes a liquid crystal display monitor (LCD monitor) as a liquid crystal display panel, which comprises, for example, a liquid crystal module 30 having a thin-film transistor (TFT) structure and an interface (I/F) board 20 connected to a digital or analog interface to a personal computer (PC) or a workstation (WS) system for supplying a video signal to the liquid crystal module 30. If a notebook PC is used, a system unit (not shown) is integrated with the liquid crystal display monitor 10. If a monitor having a display device separated from its system unit is configured, a system unit (not shown) is attached to the LCD monitor 10 to form a liquid crystal display.

The I/F board 20 comprises a input unit 27 for inputting video data from a host such as a PC/WS system, a comparison logic 24 for comparing the previous brightness with the next brightness for an input video signal, and an Application-Specific Integrate Circuit (ASIC) 21 including a logic having units such as a supplementary correction portion 25 for performing a supplementary correction. The I/F board 20 also comprises a frame buffer 22 for temporarily storing the input video signal and read-only memory (ROM) 23 containing information needed for the operation of the ASIC 21. The frame buffer 22 stores input video signal value input previously and provides it to the ASIC 21. The ROM 23 includes a graph base table 26 which is required for the supplementary correction in the ASIC 21 and is set for each of R/G/B input color signals. The graph base table 26 contains a brightness level to be output based on a relation between the previous brightness and the next brightness in a table form which will be described later.

The liquid crystal module 30 consists of three main blocks a liquid cell control circuit 31, liquid crystal cell 32, and a backlight 33. The liquid cell control circuit 31 consists of panel drivers such as an LCD controller LSI 34, a source driver (X driver) 35, and a gate driver (Y driver) 36. The LCD controller LSI 34 processes signals received from the I/F board 20 via a video interface and outputs appropriate signals to each ICs of the source driver 35 and gate driver 36 with an appropriate timing. The liquid crystal cell 32 outputs an image using a TFT array arranged in a matrix through the application of a voltage from the source driver 35 and the gate driver 36. The backlight 33 has a fluorescent tube (not shown) located on the back or side of the LC cell 32 for illuminating the cells from the back.

FIG. 2 is a graph showing an example of the brightness of a wire-frame model moving on the LCD panel used in this embodiment. The horizontal scale indicates brightness (%) desired to be provided and the vertical scale indicates brightness (%) actually provided in the Figure. The dashed line 51 indicates the relationship between the desired brightness and actual brightness of the model in a stationary state. The solid line 50 indicates the relationship between the desired brightness and actual brightness of the model in a moving state for an R (red) signal. The alternate long and short two dashes line indicates a G (green) signal in the moving state and the alternate long and short one dash line indicates a B (blue) signal in the moving state. The characteristics in the moving state vary from LCD panel to LCD panel.

Consider the case where a wire-frame model of a halftone, which is 50% brightness, is displayed on the LCD having the characteristics shown in FIG. 2. In the stationary state 51, there is no problem because the 50% brightness of a pixel can be achieved with some frames by driving the liquid crystal with a voltage providing the 50% brightness. On the other hand, in the moving state, as apparent from the line 50 indicating the brightness for the R signal in moving state, actually only 21% brightness can be obtained on the display even by driving the liquid crystal with a voltage equivalent to 50% brightness. To achieve an actual brightness of 50%, the LC must be driven with an voltage equivalent to 83% brightness. That is, an offset of 33% is required to be applied to the input voltage equivalent to 50% brightness. For the B signal, more offset is required. Though the brightness for G signal is somewhat closer to that in the stationary state 51, an offset is still required to be applied.

The relationship between the response characteristic of liquid crystal and flicker will be further discussed below.

FIG. 3 is a table showing the measurements of the response time of liquid crystal at the maximum brightness in five LCD models (models A to E). In a model 61 shown in the first column, the symbol in parentheses indicates the magnitude of flicker at the maximum brightness. Symbol "○" indicates that almost no flicker is visually perceived, symbol "Δ" indicates that flicker level is quite acceptable, and symbol "X" indicates that intensive flicker is perceived. Response rising time 62 is shown in the second column and response falling time 63 is shown in the third column. The light quantity ratio 64 in the forth column represents the ratio of the light quantity of each model to that of an ideal LC. The ratio of the brightness of the drawing in a moving state to that in a stationary state 65 is indicated in the fifth column. The brightness ratio of the drawing in moving state to that in stationary state 65 represents to what degree the brightness of the wire-frame model in the moving state is darkened compared to the brightness of that in the stationary state. It can be seen that while there is almost no reduction in brightness in model A (1.0:1), brightness is reduced in models B (0.8:1), D (0.7:1), and E (0.3:1), on which flicker is perceived.

In terms of whether the response at the maximum brightness is adequately fast, both of the response rising time 62 and the falling time 63 of model A is poor compared to model B. However, when a wire-frame model in an actual CAD application is displayed and moved on these LCD models, flicker in model A is less than in model B. The reason can be explained by considering the characteristics of human visual perception. It is known that the human visual perception is subject to a time integration effect ("Handbook of information technology for television image", 1st edition, pp.39–40, Institute of Television Engineers of Japan, 1990). Brightness of a pixel to the human eye cannot be considered in terms of time required to reach a specified brightness, instead, it should be considered in terms of the quantity of light, that is, a brightness change integrated with respect to time.

FIG. 4 shows the response characteristic of an ideal liquid crystal and indicates the state in which a particular pixel is kept lit up at a brightness of L1, that is in a stationary state. Here, the quantity of light (S) emitted in one frame time (T) is equal to L1×T (i.e. brightness×time) as shown in the shaded area in FIG. 4.

FIGS. 5A and 5B show the response characteristic represented by brightness versus time when a pixel stays lit up for one frame time (On→Off) in models A, B shown in FIG. 3. Both of the rising and falling of the response of model A shown in FIG. 5A are gradually. As a result, the quantity of light ($S_A'$) which is almost the same as that in the ideal LC shown in FIG. 4 can be obtained ($S_A' \approx S$). On the other hand, even though the response rising of model B is rapid, the falling is also rapid and steep as shown in FIG. 5B. Accordingly, quantity of light $S_B'$ is only 81% of that of the ideal LC as shown the column "Light quantity ratio" 64 in FIG. 3. Therefore, even though the response time of model B is better than that shown in FIG. 5A, there is a difference in brightness (the brightness in model B is less than model A) due to the difference in light quantity ($S_B' < S_A'$) in stationary/moving states, causing flicker when the wire-frame model is moved on model B. As can be seen from the results for models C, D, E in FIG. 3, displays providing a smaller light quantity ratio 64 provide a smaller brightness ratio 65 of a drawing in a moving state to that in a stationary state, resulting in more flicker.

Although the ultimate solution to these problems is to develop an LC device having an ideal response characteristic as shown in FIG. 4, it will be some time before such a device comes into use. Thus, another solution is required for inhibiting flicker even in LC devices having moderate response time.

One of the effective solutions may be a method that uses the measurement of a brightness difference between the stationary state 51 and moving state 50 as shown in FIG. 2. That is, a wire-frame model is drawn with an adequate gray scale by taking account of a required offset, which can be read from the graph shown in FIG. 2, during the movement of the wire-frame model.

FIG. 6 shows an effect when brightness is set by taking a required offset into account. If the liquid crystal is driven trying to achieve desired brightness L1 as target, only the quantity of light (S') indicated by reference number 71 can be obtained due to the response time of the liquid crystal described above. The quantity of light (S') 71 is much smaller than the quantity of light (S) provided by the ideal response characteristic shown in FIG. 4. On the other hand, if the liquid crystal is driven with the aim of achieving brightness L2 which is larger than the desired brightness of L1, the quantity of light (S") indicated by reference number 72 can be obtained. By overdriving the LC to brightness L2, the LC reaches L1 in a short response time and the quantity of light (S") 72 can be obtained which is approximately the same as the quantity of light (S), which would be provided with the ideal response characteristic (S"≈S). Here, optimum brightness L2 with respect to L1 can be obtained from the data shown in FIG. 2.

FIG. 7 is a table showing a relation between brightness L1 and L2 and represents the content of the graph base table 26 stored in the ROM 23 shown in FIG. 1. The content of the graph base table 26 shown in FIG. 7 represents a relation between the previous brightness and the next brightness for the LC cell 32 having the characteristic shown in FIG. 2, by taking the effect shown in FIG. 6 into consideration. The previous brightness can be obtained from a video signal input through the ASIC21 shown in FIG. 1 and stored in the frame buffer 22. The next brightness can be obtained from the next video signal input to the ASIC 21. The graph base table 26 is constructed for each of the R, G, B color signals and the values in the table vary depending on the characteristic of the LC cell 32.

The first row of the graph base table 26 shown in FIG. 7 indicates brightness output for the next brightness when the previous brightness is 0 and match the readings of the R signal in the moving state line 50 in the graph shown in FIG. 2. For example, if the next brightness is "10", find a value of 10% on the vertical scale and follow the horizontal line from that point to the point at which the line intersects the moving state line 50, and a value 28%, which is the desired brightness, can be read. When brightness rises from a certain halftone to another halftone, the offset difference is added to the previous brightness. For example, if the previous brightness is 10 and the next brightness is 20, then (48–28)+10=30. If the next brightness is 30, then (63–28)+10 =45. Similarly, if the previous brightness is 20 and the next brightness is 30, then (63–48)+20=35. If the previous brightness is 30 and the next brightness is 40, then (74–63)+30=41. In this embodiment, if a difference between the previous brightness and the next brightness is greater than an offset, the next brightness is output without change. For example, if the previous brightness is 10 and the next brightness is 80, then the offset is (96–28)=68. If the previous brightness value, 10, is added to this offset, the result would be 78. In this case, the brightness of 80 is output in order to ensure the next brightness.

On the other hand, when brightness falls from a certain halftone to another halftone, the offset is subtracted from the previous brightness. The example in FIG. 7 shows a case where the characteristic of the LC cell 32 when brightness rises (the cell is turned on) is the same as that when the brightness falls (the cell is turned off). In this example, if the previous brightness is 100 and the next brightness is 10, the output value will be 100–98=2. The value "98" is equal to the value when the previous brightness is 0 and the next brightness is 90 in FIG. 7. Similarly, if the previous brightness is 100 and the next brightness is 20, then 100–96=4. If the previous brightness is 90 and the next brightness is 30, then 100–75=25. The value "75" is equal to the value when the previous brightness is 10 and the next brightness is 70 in FIG. 7. Similarly, if the previous brightness is 90 and the next brightness is 40, then 100–70=30. The value "70" is equal to the value when the previous brightness is 10 and the next brightness is 60 in FIG. 7.

While in the table in FIG. 7 the values of previous and next brightness are indicated in increments of 10 for clarity, the table in practice is constructed to store all the combinations which can be read from measurements as shown in FIG. 2. For example, brightness values in increments of 1 may be stored, and any other degree of precision may be chosen according to a given device. While brightness is expressed in percent figures in FIG. 7, the expression of addresses and value stored in the table is not limited to percentage, instead, any appropriate quantized values manageable in a given circuit may be used.

FIG. 8 is a graph showing brightness desired to be provided versus brightness provided actually when brightness falls. The liquid crystal in the example in FIG. 8 has brightness which falls with exhibiting a characteristic similar to the rising characteristic shown in FIG. 2. Accordingly, the line 80 indicating a moving state shown in FIG. 8 is the vertically-flipped curve of the line 50 in a moving state shown in FIG. 2. Tick mark labels on the horizontal scale are also inverted. As can be seen from the graph, when the brightness actually provided is 50%, the brightness desired to be provided is 17%. This matches the value when the previous brightness is 100 and the next brightness is 50 in the table in FIG. 7. That is, the moving state line 80 in FIG. 8 exactly indicates the fall of the previous brightness from 100% in FIG. 7.

While the embodiment has been described with respect to the example which exhibits the same rising (from OFF to ON) and falling (from ON to Off) characteristics, these characteristics may vary depending on the types of liquid crystals. Therefore, the embodiment is configured to accommodate the variation of characteristics by modifying the values in FIG. 7 according to the characteristics of a given liquid crystal.

As described above, the embodiment is configured to store offsets in table form based on the relation between a brightness level in a stationary state and that in a moving state in order to obtain an ideal quantity of light. Thus, even during the movement of a display image on the LCD screen, the image can be displayed virtually the same brightness to the eye as in its stationary state, thereby inhibiting flicker on the screen.

In addition, the embodiment is configured to store the previous brightness level (gray scale value) in the frame buffer 22 and a supplementary correction is made by the ASIC 21 using the data in the graph base table 26 based on the relation between the brightness level of the next video data and the previous brightness level. Thus, whether a wire-frame model is moving or stationary is not required to be determined. Instead, the movement of the model can be determined from a difference between the determined brightness and the previous brightness. As a result, flicker can be inhibited by a simple circuit configuration.

Furthermore, the embodiment addresses the flicker problem resulting from the response time of the LC panel in recognition of the importance of the quantity of light (brightness×time) to visual perception. As a result, slow response of any types of liquid crystals (such as TN, IPS, and MVA) can be compensated by constructing a look-up table adapted to the characteristics of each liquid crystal. Thus, a flexible liquid crystal control circuit and liquid crystal display which can be widely used can be provided.

As described above, according to the invention, flicker of LCDs which poses a considerable problem in applications such as the display of wire-frame model can be made unperceivable to the user's eye by a simple configuration.

While this invention has been described in terms of certain embodiment thereof, it is not intended that it be limited to the above description, but rather only to the extent set forth in the following claims. The embodiments of the invention in which an exclusive property or privilege is claimed are defined in the appended claims.

We claim:

1. A liquid crystal display, comprising:

an input logic for inputting a video signal from a host;

a storage for storing the previous brightness level of the video signal input through said input logic;

a determinator for determining an output brightness level based on the previous brightness level stored in said storage and the next brightness level of the next video signal input to said input logic so as to make a time integration quantity of a brightness change substantially equal to an ideal quantity of light in a stationary state with respect to the next brightness level; and a driver for driving an image displaying liquid crystal cell based on said output brightness level determined by said determination logic.

2. The liquid crystal display according to claim 1, wherein said determinator comprising a table for storing a brightness level determined by the characteristic of a liquid crystal cell according to a relation between the previous brightness level and the next brightness level, and determining the output brightness level by modifying said next brightness level based on the brightness level read from said table.

3. The liquid crystal display according to claim 2, wherein:

said video signal input through said input logic comprises a plurality of color signals; and said table in said determinator is provided for each of said color signals.

4. A liquid crystal display, comprising:

a driver for driving each of the pixels forming an image for each frame to a liquid crystal cell displaying said image;

an input logic for inputting a moving-state video signal which changes from the on state to the off state on transition to a particular frame in said frames and returns to the off state after said particular frame is completed;

a setting logic for setting an offset for making the quantity of light closer to the quantity of light in a stationary state in which said moving-state video signal is continuously turned on for said particular frame;

a generator for applying said offset set by said setting logic to said moving-state video signal input through said input logic to generate an output video signal; and an output logic for outputting said output video signal generated by said generator to said driver.

5. The liquid crystal display according to claim 4, wherein said offset set by said setting logic can be determined based on a time integration quantity and the quantity of light in said stationary state, said time integration quantity being a change in brightness in said moving-state vide signal integrated with respect to time.

6. The liquid crystal display according to claim 4, wherein:

said moving-state video signal input through said input logic comprises a plurality of color signals;

said offset set by said setting logic is determined for each of said color signals; and said generator generates the output video signal for each color signal based on said offset determined for each color signal.

7. A liquid crystal control circuit, having a function for inhibiting flicker caused by a difference in brightness when an input wire-frame model is displayed by liquid crystal cells, comprising:

a storage portion for storing an offset in brightness in a moving state in which said wire-frame model having a predetermined gray scale changes from frame to frame with respect to a particular pixel, with relation to brightness output in a stationary state in which the wire-frame model having the predetermined gray scale is displayed on the particular pixel across a plurality of frames; and a correction portion for applying said offset stored in said storage portion to the gray scale of the wire-frame model if said input wire-frame model is in a moving state.

8. The liquid crystal control circuit according to claim 7, further comprising a frame buffer for storing the brightness information of said input wire-frame model as the previous brightness, wherein said storage portion stores said offset as table information based on a relation between said previous brightness stored in said frame buffer and the brightness of the next input wire-frame model.

9. A flicker inhibition method for inhibiting flicker caused by a difference in brightness when an input wire-frame model is displayed by a liquid crystal cell, comprising the steps of:

storing a relation between brightness in a stationary state in which a wire-frame model having a predetermined gray scale is displayed on a particular pixel and a plurality of frames and brightness in a moving state in which the wire-frame model having the predetermined gray scale changes frame to frame with respect to the particular pixel;

applying an offset based on said stored relation to the gray scale of said wire-frame model if said input wire-frame model is in a moving state; and driving said liquid crystal cell based on said gray scale to which said offset is applied to display said wire-frame model.

10. The flicker inhibition method according to claim 9, wherein said storing step said moving state brightness used for storing said relation is the brightness when said particular pixel changes back to the off state one frame after said particular pixel is driven from the off state to the on state during the passage of the wire-model frame over the particular pixel.

11. The flicker inhibition method according to claim 9, wherein said storing step said brightness in the moving state which is used when said relation is stored is the quantity of light equal to a brightness change integrated with respect to time.

12. A liquid crystal driving method, comprising the steps of:

storing first brightness information for an input pixel in a frame buffer;

applying based on second brightness information for the next input pixel and said first brightness information stored in said frame buffer an offset for making the time integration quantity of a brightness change substantially equal to an ideal light quantity which is the brightness in a stationary state to said second brightness information;

outputting said second brightness information to which said offset is applied to a driving circuit for driving an liquid crystal cell; and storing said second brightness information for the input pixel in a frame buffer.

13. The liquid crystal driving method according to claim 12, wherein:

said step of storing said first brightness information in the frame buffer stores said first brightness information for each of said color signals and said input pixel comprises a plurality of color signals; and said step of applying the offset applies said offset to each of said color signals.

14. The liquid crystal driving method according to claim 12, wherein said offset applying step comprises the steps of reading a pre-stored offset based on a relation between said first and second brightness information and applying said read offset to said second brightness information.

* * * * *

US006778160C1

(12) EX PARTE REEXAMINATION CERTIFICATE (8280th)

United States Patent
Kubota et al.

(10) Number: US 6,778,160 C1
(45) Certificate Issued: May 31, 2011

(54) LIQUID-CRYSTAL DISPLAY, LIQUID-CRYSTAL CONTROL CIRCUIT, FLICKER INHIBITION METHOD, AND LIQUID-CRYSTAL DRIVING METHOD

(75) Inventors: Tetsu Kubota, Fujisawa (JP); Akihiro Funakoshi, Kamakura (JP); Takuya Ishikawa, Hino (JP)

(73) Assignee: AU Optronics Corporation, Science-Based Industrial Park, Hsinchu (TW)

Reexamination Request:
No. 90/009,612, Dec. 1, 2009

Reexamination Certificate for:

| | |
|---|---|
| Patent No.: | **6,778,160** |
| Issued: | **Aug. 17, 2004** |
| Appl. No.: | **09/760,131** |
| Filed: | **Jan. 12, 2001** |

(51) Int. Cl.

| | |
|---|---|
| ***G02F 1/133*** | (2006.01) |
| ***G02F 1/13*** | (2006.01) |
| ***G02G 3/36*** | (2006.01) |
| ***G02G 3/29*** | (2006.01) |

(52) U.S. Cl. ..... 345/89; 345/690; 345/77; 345/88; 345/98

(58) Field of Classification Search ..... None
See application file for complete search history.

(56) References Cited

U.S. PATENT DOCUMENTS

| | | | |
|---|---|---|---|
| 5,229,860 | A | 7/1993 | Kido et al. |
| 5,347,382 | A | 9/1994 | Rumbaugh |
| 5,495,265 | A | 2/1996 | Hartman et al. |
| 5,528,257 | A | 6/1996 | Okumura et al. |
| 6,304,254 | B1 | 10/2001 | Johnson et al. |
| 6,320,562 | B1 | 11/2001 | Ueno et al. |

FOREIGN PATENT DOCUMENTS

| | | |
|---|---|---|
| JP | 7-56532 | 3/1995 |
| JP | 2000338916 A | 12/2000 |

OTHER PUBLICATIONS

Japanese Language Office Action dated Mar. 2, 2010.
Japanese Language Office Action dated Sep. 29, 2009 and English translation of Office Action.

*Primary Examiner*—Fred Ferris

(57) ABSTRACT

A liquid crystal display comprises an input for inputting a video signal from a host and a storage medium for storing the previous brightness level of the video signal input through the input. A determinator is provided for determining an output brightness level based on the previous brightness level stored in the storage medium and the next brightness level of the next video signal input to the input, so as to make the time integration quantity of a brightness change substantially equal to an ideal quantity of light in a stationary state with respect to the next brightness level. Further included are drivers for driving an image displaying liquid crystal cell based on the output brightness level determined by the determinator.

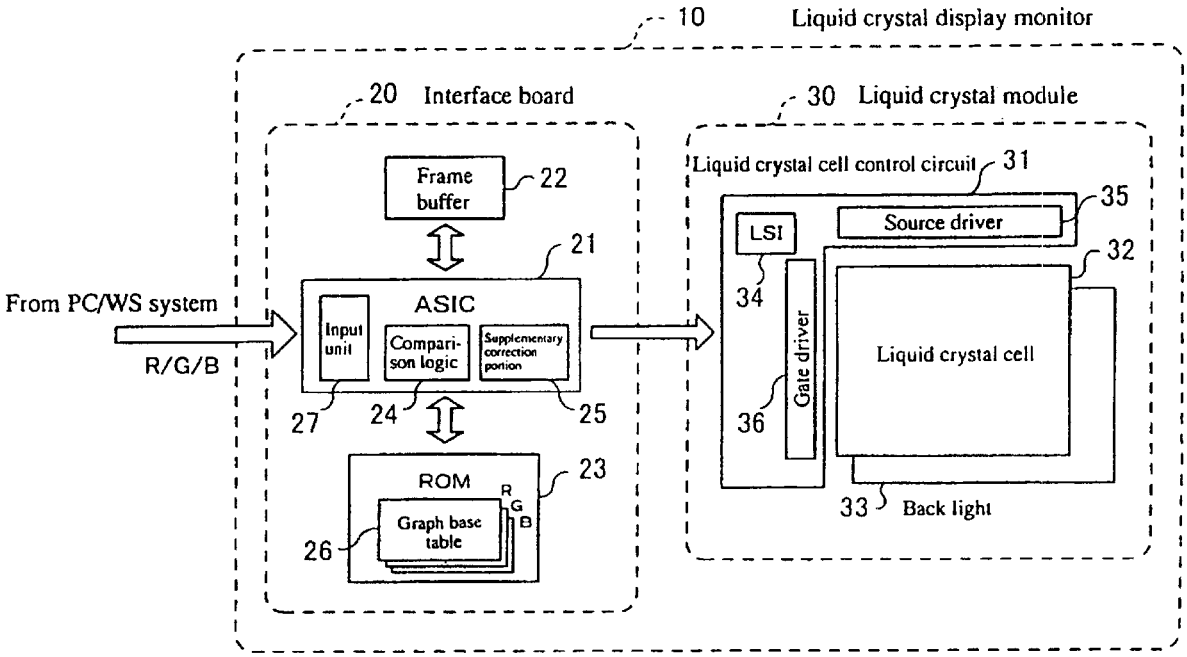

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-3 and 12-13 is confirmed. Claims 4-11 and 14 were not reexamined.

* * * * *